United States Patent [19]

Zufich

[11] 4,114,788

[45] Sep. 19, 1978

[54] FRONT LOAD CARRYING APPARATUS FOR BACKPACKS

[76] Inventor: Anthony C. Zufich, P.O. Box 333, Bodfish, Calif. 93205

[21] Appl. No.: 820,741

[22] Filed: Aug. 1, 1977

Related U.S. Application Data

[63] Continuation-in-part of Ser. No. 690,068, May 26, 1976.

[51] Int. Cl.[2] ..... A45F 3/10

[52] U.S. Cl. ..... 224/25 A; 224/5 N

[58] Field of Search ..... 224/8 R, 25 A, 5 BC, 224/5 R, 5.1, 5 A, 5 B, 5 G, 5 E, 5 T, 5 H, 5 K, 5 M, 5 N, 5 P, 5 Q, 5 MA, 5 MC, 5 W, 6, 8 A, 9, 25 R

[56] References Cited

U.S. PATENT DOCUMENTS

| | | | |
|---|---|---|---|
| 3,106,037 | 10/1963 | Harkey | 224/25 R X |
| 3,831,827 | 8/1974 | Olson | 224/25 A |

FOREIGN PATENT DOCUMENTS

| | | | |
|---|---|---|---|
| 1,017,357 | 12/1952 | France | 224/8 R |
| 63,451 | 4/1941 | Norway | 224/8 R |
| 82,261 | 8/1953 | Norway | 224/8 R |

*Primary Examiner*—Trygve M. Blix
*Assistant Examiner*—Jerold M. Forsberg
*Attorney, Agent, or Firm*—Michael A. Painter

[57] ABSTRACT

Apparatus to be utilized with backpack equipment to support counter-balancing loads adjacent the chest of the user. A backpack and frame apparatus is adapted with the front load carrying apparatus. A pair of front load carriers are pivotally journeled to the backpack frame, the front load carriers extending substantially perpendicular to the backpack frame and lying on the opposite side of the frame as the backpack. The front load carriers are adapted to be adjacent the chest of the user and to be secured to one another once the pack has been mounted. The pivotal couplings between the front load carrier and the pack frame allow the front load carriers to encompass the girth of the user and to be alternately opened to provide the user easy means for mounting or removing the pack. When the pack and frame are mounted upon the user, the front load carriers are joined to one another at the front of the user, load carrying containers being affixed to the front load carriers. The load attached to the front load carriers apply a force to the backpack frame and assembly which counter-balances the force which results from any material which is stored in the conventional backpack.

9 Claims, 4 Drawing Figures

FRONT LOAD CARRYING APPARATUS FOR BACKPACKS

This is a continuation-in-part of my co-pending application Ser. No. 690,068 filed May 26, 1976.

BACKGROUND OF THE INVENTION

1. Field of the Invention

The present invention generally relates to camping and hiking equipment and more particularly to pack frames and rucksacks which are adapted to be utilized by campers, hunters, fishermen, climbers and the like. 2. Prior Art There are numerous pieces of prior art which disclose backpacks, pack frames and related apparatus. One of the most pertinent pieces of prior art discloses a pack frame and sack therefor which has a primary object to provide a pack frame by which a major portion of the load is carried by the hips of the user. In this device, the hip strap is padded and is tightened about the hips of the user in a position which is intended to engage the hip bones. The load carried by the sack is transferred to the hip strap at each side rather than primarily to the back or shoulders of the user. In this device, an L-shaped hip tube having an upright post and a forward extending arm is mounted adjacent the lower end of side bars and extends forwardly along the hip of the user. A joint for connecting each hip tube and the side bars is adjustable upwardly and downwardly along the side bar while a series of differently angled holes in the post of the hip tube permits the angle of the hip tube to be varied through the use of a removeable pin. The hip strap includes an outer strap and inner padding and is tightened about the hips of the user while a pin carried in each side of the hip strap extends through a grommet at the lower end of the corresponding shoulder strap and through the corresponding hip tube so that the weight of the pack is concentrated at the sides of the hips of the user rather than on the shoulder. The inadequacies of this device are obvious. Since the hip tubes are attached rigidly to the frame of the pack on one end, and to a single point on the belt at the other, that weight of the pack which is not being carried by the shoulders is brought to bear on a small area over each hip. Since the hips rise and fall in walking, friction occurs between the belt and the hip.

Another backpack and frame disclosed by the prior art utilizes a hip belt which is disposed about the waist of the wearer. The pack frame has two substantially vertical side bars and remaining sections of tubing and tees which form the side and transverse connectors of the frame. At least some of the joints of the tubing sections and tees are detachable so that the frame may be disassembled. The hip belt is disposed about the waist of the wearer and holds the bottom of the frame in a vertical position. The problem which arises by use of this device is apparent in its design. An attempt is made to support the load about the waist of the user, but there is no provision for support and independence between the load and the user.

Another pack frame and assembly which is disclosed by the prior art is adapted to be carried upon a person's back through the use of shoulder straps and having hip-engaging means thereon to bear on a portion of a person's hip so as to carry the majority of the load thereagainst. The hip-engaging means includes a backplate assembly having a pair of anchor plates connected to respective ones of the support tube members which constitute the primary vertical support of the pack. The belt assembly is adapted to be placed about the waist of the user above the hip line, the full weight of the pack frame being centered at the waist of the user on opposite sides thereof as well as the user's shoulders. As with the devices described hereinabove, the inability to provide independence of movement between the user and the load renders the prior design inadequate.

Applicant's co-pending application discloses another form of a backpack and frame. A countoured belt is adapted to be disposed about the waist of the user, the belt including downwardly extending load support panels which are adapted to be coupled to the load at a point which is substantially below the waist. A rigid support member or yoke is coupled to the lower portions of the supporting extensions and extends about the rear of the user. The pack frame is pivotally coupled to the yoke in a manner which will permit the user to have normal rotational hip action without being unduly retarded by the load being carried. In this manner, the support of the load at a point substantially below the waist of the user provides for better distribution of the load to the hips and the non-rigid coupling between the yoke and the frame provides for independence of movement between the user and the load. The prior art discloses a device for attaching loads along the chest of the user, but these devices are generally directed to adding additional load carrying capabilities. The mere addition of loads to the front portion of a backpack or rucksack frame leave substantial problems unresolved. Unless the complete load can be supported in a manner which will substantially reduce or totally eliminate the torsional forces created by the loads, the mere addition of load carrying capability is unsatisfactory. The present invention substantially resolves the problems inherent in the prior art. Contoured front load carries are pivotally mounted to the vertical supports of a backpack frame. The front load carriers are adapted to close about the girth of the user in a manner which will place the front load carrier substantially adjacent the lower portion of the user's chest. The front load carriers create torsional load arms which will counter-balance the load which is carried at the rear portion of the pack. By permitting the front load carrier to pivot about the pack frame, the user can easily mount or remove the pack assembly in a manner which is a substantial improvement over the devices disclosed in the prior art.

SUMMARY OF THE INVENTION

The present invention front load carrying apparatus can be adapted for use with any conventional backpack or rucksack which employs a pair of laterally spaced structural members for implementation of the frame and which supports a back carried load thereon. Although the scope of the present invention is broad enough to be utilized with conventional backpacks or rucksacks, for the purpose of example, the present invention shall be defined in connection with the backpack and frame apparatus described in Applicant's co-pending application, Ser. No. 690,068 filed May 26, 1976. For this specific structure, a pair of side frame members are pivotally coupled to a yoke which is adapted to be disposed about the rear of the user. The yoke is a substantially semi-circular support frame which is adapted to move independently of the pack frame. By pivotally coupling the support frame and yoke to the pack frame, the hips and legs of the user will be free to move in a normal manner independent of the load which is being carried by the pack frame. A supporting belt is disposed about the waist of the user, the belt having downwardly depending panels or gussets along the hips of the user. The downwardly extending supporting panels each include appropriate couplings which are disposed substantially below the waistline of the user. The couplings lie on opposite sides of the user and are in substantially the same plane. The support frame and yoke are joined to the coupling of the support belt. By joining the support frame-yoke to the supporting belt by means of gussets which allow for attachment at a point which is substantially below the waistline of the user, the full load which is being supported by the pack frame will be distributed along the hips of the user in a manner which cannot be obtained where gussets are not used and the load is attached directly to the belt. The pack frame is pivotally coupled to the support frame-yoke in a manner which will permit the support frame-yoke to rock or otherwise have independence of movement with respect to the pack frame. When the user moves in a normal manner, his hips will tend to rock and thereby transfer equal motion to the support frame-yoke. The pack frame is held in place by shoulder straps and therefore can be maintained in a stable position irrespective of the rocking movement which is transferred to the yoke by the ambulatory motion of the user.

Irrespective of the support for the pack frame, the forces imposed by the load being carried on the user's back will still create an unbalanced load. A pair of front load carriers are pivotally coupled substantially perpendicular to the vertical side members of the frame assembly and are adapted to lie on the opposite side of the plane of the support frame from the main back carried load. The front load carriers are adapted to enclose the girth of the user and be coupled to one another at a location substantially adjacent the chest of the user. The portion of the front load carriers which are in abuttment are coupled to one another to prevent lateral or frontal movement thereof, and appropriate front loads are mounted thereon to counter-balance the back loaded force. In use, substantially all of the weight to be carried by the user will be supported upon the hips of the user when the defined form of the frame assembly is used. The torsional force imposed by the front load is directionally opposite that of the rear mounted load thereby making it substantially easier for the user to carry greater loads.

It is an object of the present invention to provide an improved backpack frame and assembly.

It is another object of the present invention to provide a backpack frame and assembly which utilizes front mounted loads.

It is still another object of the present invention to employ a backpack frame assembly which will support front mounted loads along the hips of the user.

It is still yet another object of the present invention to provide a pack frame and assembly utilizing front load carriers which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
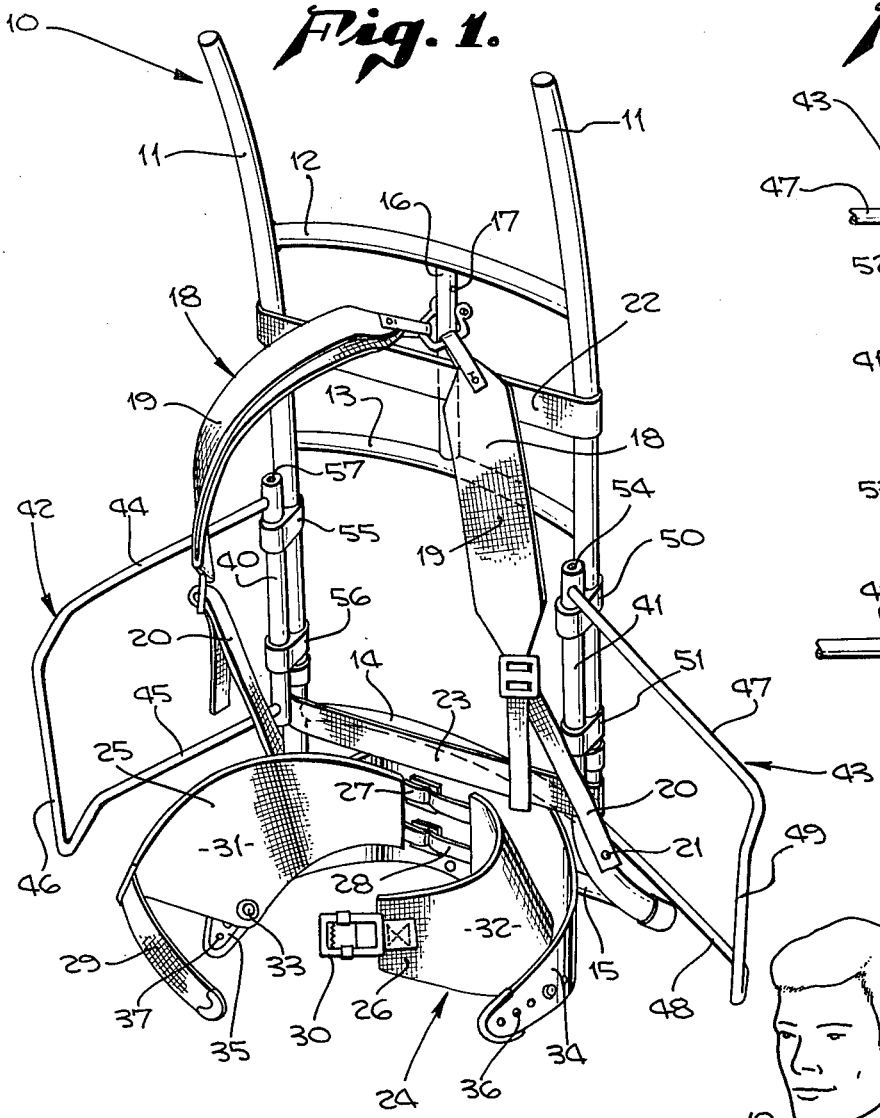
FIG. 1 is a front perspective view of a backpack frame assembly incorporating the present invention front load carrier.

An understanding of the present invention can be best gained by reference to FIG. 1 wherein a backpack frame assembly is shown therein incorporating front load carrying apparatus. Although the present invention is capable of being utilized with conventional backpack or rucksack equipment which utilize uniformly spaced supports for implementation of the frame, the present invention shall be discussed in connection with the backpack frame assembly described in Applicant's co-pending application Ser. No. 690,068 filed May 26, 1976. Backpack and frame assembly 10 comprises a pair of frame side members 11 which are disposed in parallel spaced relation to each other. Lateral cross members 12, 13, 14 and 15 are coupled intermediate frame side members 11 in a manner which will maintain rigidity of frame 10 and maintain the appropriate spacing between side members 11. Although any conventional coupling may be utilized, lateral cross members 12, 13, 14 and 15 are typically welded to frame side members 11 if appropriate materials are used. Where it is desired to produce a form of frame 10 which is lightweight, side members 11 and lateral cross members 12, 13, 14 and 15 are preferably formed of lightweight tubing such as aluminum. Where the elements of frame assembly 10 are fabricated of materials which cannot be welded, appropriate mechanical couplings can be substituted therefor.

Shoulder strap support tube 16 is coupled to intermediate lateral cross members 12 and 13. Support tube 16 includes aligned, vertical adjustment apertures 17 in spaced relation to one another. Shoulder straps 18 include a padded section 19 which is adapted to be disposed across the shoulders of a user, padded sections 19 being coupled to the lower portions of frame side members 11 through the use of adjustable straps 20. Straps 20 are joined to side members 11 by grommets and clevis pins or any other conventional mechanical coupling means 21 at a position which is substantially at the waist of the user. The termini of padded sections 19 opposite to straps 20 are coupled to a clevis which is attached to the shoulder strap support tube by means of a clevis pin that passes through one of the adjustment apertures 17 to conform to the size requirement of the user. Webbing 22 and 23 is laterally disposed between pack frame side members 11 to cushion the load against the back of the user and provide an air space between the user and the backpack supported in frame 10. Additional comfort may be created by increasing the curvature of lateral cross member 13 to account for the typical curvature which would occur at the mid-section of the back of a user. As will be described hereinbelow, lateral cross member 15 does not come in contact with the user and therefore is substantially straight.

Primary support for the backpack and frame assembly 11 is derived from support belt 24. Support belt 24 is typically fabricated of a pair of complementary sections 25 and 26 which are disposed on either side of the user along the user's hips. Support belt 24 is preferably fabricated from an interlaced, mesh structure although a padded foam construction can be utilized. Use of a mesh structure will combine the necessary strength with means for cooling the areas of the user which are covered by belt 24. Sections 25 and 26 are joined at the rearward juncture thereof by straps 27 and 28. Although straps 27 and 28 provide for increased flexibility of belt sections 25 and 26, it is obvious that a unitary structure could be utilized to implement supporting belt 24. A conventional strap 29 is securely affixed to supporting section 25, a mating buckle 30 being affixed to supporting section 26 to provide for a mating assembly. Belt assembly 29 and 30 are adapted to be secured about the waist of the user in a secure manner to provide the base for supporting the loads held by the present invention backpack frame assembly 10.

Supporting sections 25 and 26 each include downwardly extending panels 31 and 32 which comprise gussets which extend along the user's hips. The apex of each gusset 31 and 32 has a complementary aperture thereto and incorporates grommets 33 therein to provide the means for coupling the backpack frame assembly 11 thereto. The tapered profile of gussets 31 and 32 provide means for distributing any load thereon about substantially the full periphery of supporting belt 24.

The assembly upon which the present invention is mounted utilizes a supporting structure to pivotally couple frame assembly 10 to supporting belt 24. The supporting structure has a substantially planar rear section which depends at either end thereto into tapered flanges 34 and 35. The termini of flanges 34 and 35 are substantially parallel to each other and each have a respective set of adjustment apertures 36 and 37 which are adapted to be aligned with grommets 33. The size of the user will determine the appropriate adjustment and appropriate coupling means are used to secure the support structure to gussets 31 and 32 at grommets 33. Typical coupling means are shown in FIG. 1.

As stated hereinabove, an objective of the present invention is to provide for means to counter-balance the force which will be imposed by loads carried by conventional backpacks. Referring again to FIG. 1, a pair of cylindrical shafts 40 and 41 are respectively coupled in parallel spaced relation to each of the frame side members 11. A pair of substantially U-shaped load carrying brackets 42 and 43 are secured to cylindrical shafts 40 and 41 respectively. Load carrying bracket 42 comprises a pair of substantially parallel legs 44 and 45 which are joined by a coupling leg 46 which is substantially parallel to cylindrical shaft 40. In a like manner, load carrying bracket 43 comprises a pair of parallel legs 47 and 48 which are joined by a coupling leg 49 which is substantially parallel to cylindrical shaft 41. As can be best seen in FIG. 1, the portion of legs 44 and 45 adjacent coupling 46 are contoured inwardly so that when load carrying brackets 42 and 43 are pivoted toward one another, coupling 46 and 49 will lie adjacent one another being adapted to encompass the girth of the user.

Figure 2:
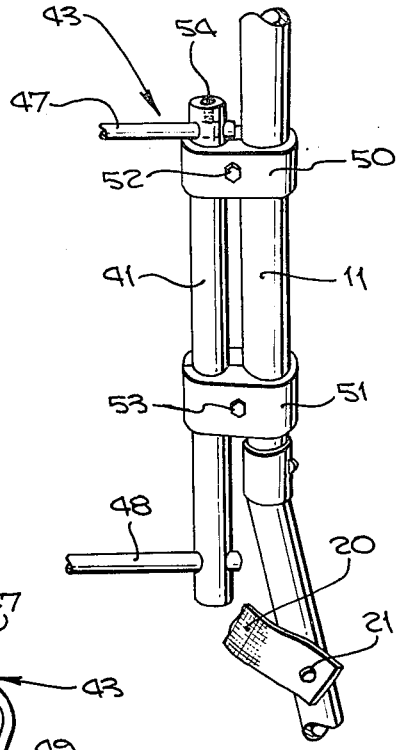
FIG. 2 illustrates the coupling between the front load carriers and the vertical frame portion shown in FIG. 1.

Referring now to FIG. 2, the structure for coupling front load carrying brackets to frame 10 is illustrated. As was described hereinabove, backpack and frame assembly 10 comprises a pair of parallel side members 11 on which the backpack is affixed. In order to properly mount the present extension front load carriers, the form of coupling shown in FIG. 2 can be utilized. As shown, cylindrical shaft 41 is mounted substantially parallel to the upper section of side member 11. In order to permit load carrying bracket 43 to be properly oriented with respect to frame 10, a pair of half-shell clamping members 50 and 51 are used to couple cylindrical shaft 41 to side member 11. As shown in FIG. 2, each of the clamping members 50 and 51 constitute half-shells having complementary depressions for receiving the surfaces of cylindrical shaft 41 and the respective side member 11. A rubber gasket is disposed between the half-shells to provide for proper seating. Conventional bolts 52 and 53 or other suitable means are used to adjustably couple the half-shells of clamping members 50 and 51 respectively. By adjusting the tension on bolts 52 and 53, the ability to rotate or pivot cylindrical shaft 41 will be provided. Parallel legs 47 and 48 of load carrying bracket 43 are disposed through respective ends of cylindircal shaft 41 on the outer side of clamp 50 and 51 respectively. As can be best seen in FIG. 2, a set screw 54 is disposed along the axis of cylindrical shaft 41 contacting leg 47 to maintain the position of carrying bracket 43 within cylindrical shaft 41. Although the discussion with respect to FIG. 2 relates only to front load carrying bracket 43, it is clear that, in a like manner, clamps 55 and 56 will be used to maintain the appropriate positions of cylindrical shaft 40. Also, set screw 57 will maintain the position of front load carrying bracket 42 with respect to cylindrical shaft 40. Although the structure shown in FIG. 2 is a preferred form of the manner in which front load carrying brackets 42 and 43 can be coupled to frame 10, it is clear that any suitable coupling which will permit the rotation and pivoting of front load carrying brackets 42 and 43 with respect to a side members 11 could be used.

By utilizing clamps 50 and 51, and 55 and 56, to secure cylindrical shafts 40 and 41 respectively, the positioning of front load carrying brackets 42 and 43 can be adjusted to fit the size of the user. Not only can brackets 42 and 43 be pivoted while maintaining the relative position of cylindrical shafts 40 and 41 with respect to side members 11, by loosening bolts 52 and 53, cylindrical shafts 40 and 41 can be angularly displaced with respect to side members 11 to account for any variation in the size of the user.

Figure 3:
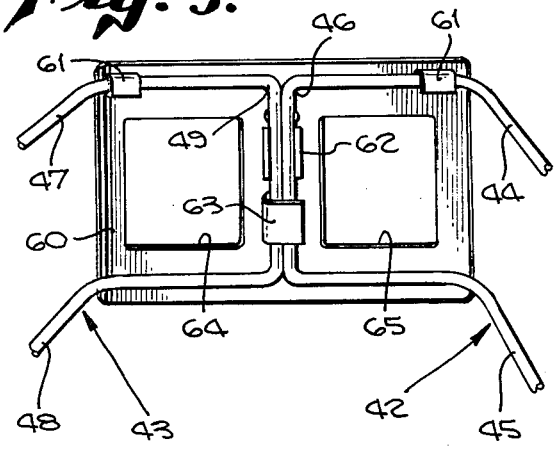
FIG. 3 illustrates an interior view of the coupled front load carriers shown in FIG. 1.

In order to provide for a suitable counter-balance to any rear carried load, front load carrying brackets 42 and 43 are mounted substantially perpendicular to side members 11 of frame 10. In this manner, any depending load will create a moment arm about the lower portion of side members 11 which will counter the torsional forces created by the loads carried on the back of the user. As stated previously, front load carrying brackets 42 and 43 are adapted to be closed about the waist or girth of a user. FIG. 3 illustrates the manner in which front load carrying brackets 42 and 43 can be closed upon a user and adapted to carry a front load. After the user has mounted frame assembly 10, front load carrying brackets 42 and 43 are pivoted within the engaged half-shell clamps until cross-legs 46 and 49 are adjacent one another.

Since it is clear that stability can only be achieved if the positioning of brackets 42 and 43 are stationary, a locking member 60 such as that shown in FIG. 3 is utilized. Locking member 60 comprises a substantially rectangular panel having a pair of downwardly directed suspension flanges 61 disposed thereon. Suspension flanges 61 are adapted to be disposed upon upper legs 47 and 44 respectively so that a load can be secured to the front surface of locking member 60. When locking member 60 is in place such as that shown in FIG. 3, the planar surface of member 60 will be substantially perpendicular to the ground. In order to insure the positional integrety of front load carrying brackets 42 and 43, locking member 60 is provided with a pair of clamps 62 and 63 to effectively lock coupling legs 46 and 49 in the lateral, forward and rearward positions. Clamp 62 is a resilient clamp which will prevent load carrying brackets 42 and 43 from inadvertently opening. Clamp 63 fits about the forward and rearward surfaces of coupling legs 46 and 49 and simultaneously prevents any movement of the brackets in the respective directions. In order to lighten the load to be carried by the user, portions 64 and 65 can be cut from the interior of locking member 60.

Figure 4:
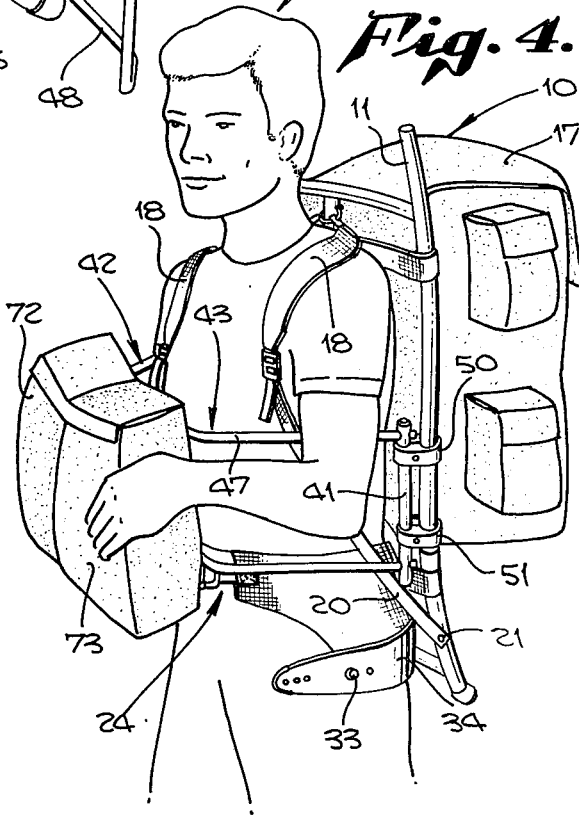
FIG. 4 illustrates a mounted backpack and frame assembly incorporating the present invention front load carriers.

Referring now to FIG. 4, the manner in which the present invention is utilized can be best seen. User 70 has straps 18 disposed over his shoulders supporting the portion of the load stored in pack 71. Pack 71 is mounted intermediate side members 11 in the manner previously discussed. Supporting belt 24 is enclosed about the waist of the user 70, the load being supported by frame assembly 10 being transmitted through supporting member 34 to gussets 31 and 32. In conformity with an objective of the present invention, the predominent portion of the load is being supported below the waist and upon the hips of the user 70. In order to counter-balance the load imposed upon the material stored in pack 71, half-shell clamps 50 and 51 maintain a substantially parallel relationship between cylindrical shaft 41 and side member 11. As can be seen in FIG. 4, front load brackets 42 and 43 are secured about the girth of user 70. In the view shown, legs 47 and 48 of front load mounting bracket 43 are disposed into cylindrical shafts 41 and secured by set screw 54. A pair of front loading containers 72 and 73 are secured to the front surface of locking member 60 by conventional couplings. A pair of front loading containers 72 and 73 are used as opposed to a single container to provide for better balance. In the configuration shown in FIG. 4, the loads carried in front loading containers 72 and 73 create a counter-clockwise torsional force about a point which is substantially intermediate half-shell clamps 50 and 51. The load maintained in rear pack 71 will create a clockwise force which will be directed about a typically shorter moment arm. In this way, the load supported by front loading containers 72 and 73 can be substantially less than that carried in pack 71 and still create counter-balancing torque. Although the form of the present invention shown utilizes a pair of front load carrying brackets which are secured about the girth of the user, it is clear that the front loading brackets can be implemented by members which will extend forwardly and in a parallel position on either side of the user with a front load being suspended therebetween.

The present invention provides a simplified method whereby the loads carried in a backpack or rucksack can be substantially increased by simultaneously eliminating the torsional forces which are inherent in the singular use of a backpack. By providing front loading brackets which can be closed about the user after mounting the pack frame assembly, a front load can be disposed thereon to fully counter-balance the load being carried on the user's back. The manner of mounting the front loading brackets are adjustable to the size and girth of a user, substantially the full load being carried and being supported by the hips of the user rather than at a higher point along the user's back and shoulders. The manner by which the present invention permits carrying increased loads while eliminating the difficult problems relating to the placement of loads within backpacks produces a substantial improvement over the devices disclosed in the prior art.

I claim:

1. A backpack and frame apparatus including a pair of frame members for supporting a rear load comprising:

(a) hip belt means for encircling the waist of the user, said hip belt means including downwardly depending panels adapted to lie along the hips of the user, each of said panels including coupling means for attachment thereto;

(b) means for coupling said downwardly extending panels of said hip belt means to the backpack and frame;

(c) a pair of front support load arms each comprising first and second parallel legs being integrally joined at one end thereof, said first and second legs being uniformly curved toward the joined end of said support load arm;

(d) locking means for supporting a frontal, auxiliary load coupled to said front support arms;

(e) first and second shafts having parallel apertures disposed therethrough, the first and second legs of each of said front support load arms being disposed through a pair of apertures of one of said shafts;

(f) means for securing the legs of each of said front support load arms within one of said shafts respectively; and (g) means for pivotally coupling each of said first and second shafts to a lateral frame member whereby the joined ends of said first and second front support arms can be pivoted adjacent one another.

2. A backpack and frame apparatus including a pair of frame members for supporting a rear load as defined in claim 1 wherein said means for coupling said downwardly extending panels comprises a reciprocating coupling disposed intermediate said hip belt means and the frame whereby said hip belt means can reciprocally pivot in a plane defined by the frame members.

3. A backpack and frame apparatus as defined in claim 2 wherein said locking means comprises a planar member having a pair of downwardly depending flanges secured thereto, each of said flanges being disposed upon one of the aligned legs of a respective one of said first and second front support load arms.

4. A backpack and frame apparatus as defined in claim 3 further including first clamping means for laterally securing said first and second front support load arms, said first clamping means being secured to said locking unit and engaged about the joined ends of said first and second front support arms between the parallel legs thereof.

5. A backpack and frame apparatus as defined in claim 3 further including second clamping means for preventing said first and second front support load arms from moving forwardly or rearwardly with respect to each other, said second clamping means being secured to said locking unit and being disposed about the joined ends of said first and second front support load arms on opposite sides thereof.

6. A backpack and frame apparatus as defined in claim 3 including load means for supporting a load on said locking unit, said load means being secured to said locking unit on the opposite side of said flanges whereby the torsional force created by the rear supported load is counter-balanced.

7. A backpack and frame apparatus as defined in claim 1 wherein said means for pivotally coupling each of said first and second front support load arms comprises locking clamps having first and second complementary sections disposed upon opposite sides of said parallel shaft and frame member, and securing means for securing the complementary sections to one another whereby the angular position of said legs with respect to said frame member can be altered.

8. A backpack and frame apparatus including a pair of lateral frame members for supporting a rear load comprising:

(a) hip belt means for encircling the waist of the user, said hip belt means including downwardly depending panels adapted to lie along the hips of the user, each of said panels including coupling means for attachment thereto;

(b) reciprocating means for coupling said downwardly extending panels of said hip belt means to the backpack and frame;

(c) a pair of front support load arms each comprising first and second parallel legs being integrally joined at one end thereof, said first and second legs being uniformly curved toward the joined end of said support load arm;

(d) first and second shafts having parallel apertures disposed therethrough, the first and second legs of each of said front support load arms being disposed through a pair of apertures of one of said shafts;

(e) means for securing the legs of each of said front support load arms within one of said shafts respectively;

(f) a pair of locking clamps for securing each of said shafts to a respective one of said frame members, each of said locking clamps having first and second complementary members disposed upon opposite sides of the aligned shaft and frame member, and including securing means for securing said complementary members whereby the angular position of said legs with respect to said frame member can be altered;

(g) a locking unit comprising a planar member having a pair of downwardly depending flanges secured thereto, each of said downwardly depending flanges engaged upon one of the aligned legs of a respective one of said front supporting load arms whereby a frontal, auxiliary load can be supported therefrom; and (h) means for coupling said first and second front supporting load arms to one another, said means being secured to said locking unit.

9. A backpack and frame apparatus as defined in claim 8 wherein said means for coupling said first and second supporting load arms to one another comprise a first and second clamping members, said first clamping member being disposed about the joined ends of said first and second front supporting load arms on opposite sides thereof, said second clamping member being disposed about the joined end of said first and second front support load arms between parallel legs thereof.

* * * * *